US005833358A

United States Patent [19]

Patik

[11] Patent Number: 5,833,358

[45] Date of Patent: Nov. 10, 1998

[54] EXTRUDED TRACK LIGHTING SYSTEM

[75] Inventor: Thomas G. Patik, San Dimas, Calif.

[73] Assignee: ACI The Display People, Covina, Calif.

[21] Appl. No.: 751,001

[22] Filed: Nov. 15, 1996

Related U.S. Application Data

[60] Provisional application No. 60/007,411, Nov. 21, 1995.

[51] Int. Cl.[6] ..... F21V 21/32

[52] U.S. Cl. ..... 362/391; 362/226; 362/239; 439/110

[58] Field of Search ..... 439/110–112, 116, 439/117, 119; 362/226, 252, 391, 404, 432, 238, 239

[56] References Cited

U.S. PATENT DOCUMENTS

| | | | |
|---|---|---|---|
| D. 358,803 | 5/1995 | Shen | D13/155 |
| D. 361,153 | 8/1995 | Fernandes | D26/138 |
| 4,655,520 | 4/1987 | Cummings . | |
| 4,845,601 | 7/1989 | Podbury et al. | 439/110 |
| 4,861,273 | 8/1989 | Wenman et al. | 439/111 |
| 4,979,081 | 12/1990 | Leach et al. | 362/219 |
| 5,151,037 | 9/1992 | Range et al. | 439/122 |
| 5,151,038 | 9/1992 | Range et al. | 439/122 |
| 5,154,509 | 10/1992 | Wulfman et al. | 302/226 |
| 5,207,589 | 5/1993 | Lettenmayer | 439/112 |
| 5,340,322 | 8/1994 | Poulsen | 439/111 |
| 5,341,276 | 8/1994 | Shen | 362/226 |
| 5,455,754 | 10/1995 | Hoffner | 362/404 |

FOREIGN PATENT DOCUMENTS

| | | | |
|---|---|---|---|
| 3120267 | 12/1982 | Germany . | |
| 3744482 | 6/1989 | Germany . | |
| 4240220 | 6/1993 | Germany | 439/110 |
| 10363 | 4/1901 | United Kingdom | 439/116 |
| 2185863 | 7/1987 | United Kingdom | 439/119 |

OTHER PUBLICATIONS

"The Galaxis System, the low voltage contact rail lighting system from Betec", Translite Systems brochure, 1992.

National Specialty Lighting, Architectural and Decorative Lighting, 1995, Front page and pp. 22 and 23.

Bruck Lighting USA brochure, front page and pp. 3, 6, 20 and back cover.

*Primary Examiner*—Alan Cariaso

*Attorney, Agent, or Firm*—Knobbe, Martens, Olson & Bear, LLP

[57] ABSTRACT

An improved extruded track lighting system having a support rail with a pair of cylindrical conductors exposed on an insulating extrusion. Various light fixtures having clamp brackets may be easily snapped on and off the support rails. Each of the clamp brackets includes a pair of parallel flat legs having gripping portions to conform with exposed cylindrical conductors on either side of the support rail. Alternatively, the clamp brackets may include outwardly extending tangs which can be forced between a pair of conductors on the interior of the extrusion. The brackets are simply swiveled with respect to the rail to couple or remove. No independent fastening means are needed to tighten the clamp brackets to the support rails. In one embodiment a light fixture includes a single swivel axis, while in another embodiment a light fixture includes a universal joint providing two orthogonal swivel axes between the lamp and the support rail. Low-voltage electricity conducts directly through the clamp brackets and swiveling light fixtures to the lamps. The support rails may be bent about at least two axes while still allowing coupling of the light fixtures in the bend.

27 Claims, 8 Drawing Sheets

EXTRUDED TRACK LIGHTING SYSTEM

RELATED APPLICATION

Pursuant to 35 U.S.C. § 119(e), this application claims the priority benefit of Provisional Application No. 60/007,411, filed Nov. 21, 1995.

FIELD OF THE INVENTION

The present invention pertains to a track lighting system, and more particularly to an improved low-voltage conductor track and light fixture.

BACKGROUND OF THE INVENTION

A great variety of track lighting systems for interior decorating, lighting within display cases for business and home, and other uses are known. A typical configuration includes a track having an elongated cavity within which powered conductors extend. T-shaped pick-ups from lighting fixtures fit within the cavity and lock therein so that the pick-ups are in contact with the conductors. These systems typically run on standard wall current and must be covered on all sides with insulation to prevent inadvertent electric shock. Almost universally, these lighting fixtures must be fixed within the track with a separate fastener or manual clamp. This reduces flexibility of design and can be quite inconvenient for systems having a large number of fixtures.

A low-voltage system having elongated conductors is seen in U.S. Pat, No. 5,207,589 to Lettenmayer. In the Lettenmayer patent, a retainer clamp for a light holder includes retainer clamp legs and contact springs disposed within for contacting elongated conductors forming part of a conducting rod. The rod includes the two conductors separated by an insulating material, the exterior of the rod being cylindrical. Both the clamp legs and the springs are produced from an elastic material so that the entire retainer clamp may be pressed onto the conductor rod and swiveled therearound. Electrical connection wires from a lamp extend into a recess in the holder to the inside of each clamp leg. A screw tightens the retainer clamp legs together to maintain an electrical connection on each side through, in series, the contact spring, a washer and one of the wires.

In Lettenmayer, although a good electrical connection between the connection wires and the washers is desired, the wires are free to slide in relation to the washers so that the holder may be swiveled about the screw axis in relation to the retainer clamp legs. The mechanical connection between the clamp legs and holder thus serves dual, conflicting purposes of maintaining a tight consistent electrical connection, while allowing for relative sliding to pivot the holder about the screw axis. The friction from the contacting sliding surfaces introduces stress and wear on the lamp wires. Conversely, if the connection is too loose, the entire retainer clamp will swivel about the cylindrical conducting rod from the force of gravity to hang straight down, possibly disengaging the contact springs from the conductors and disabling the circuit. Even if the lamp holder does not swivel completely around, it may shift from vibration so that the desired pattern of illumination is disrupted. In addition, although the cylindrical configuration of the conducting rod enables fixtures to be swiveled to different orientations, the same feature inhibits the ease of removal of the fixtures from the rod because any rotational forces imparted to the fixture will simply rotate it around the rod.

Accordingly, there is a need for an improved low-voltage track lighting system that overcomes the deficiencies of the prior art.

DETAILED DESCRIPTION OF THE PREFERRED EMBODIMENTS

Figure 1:
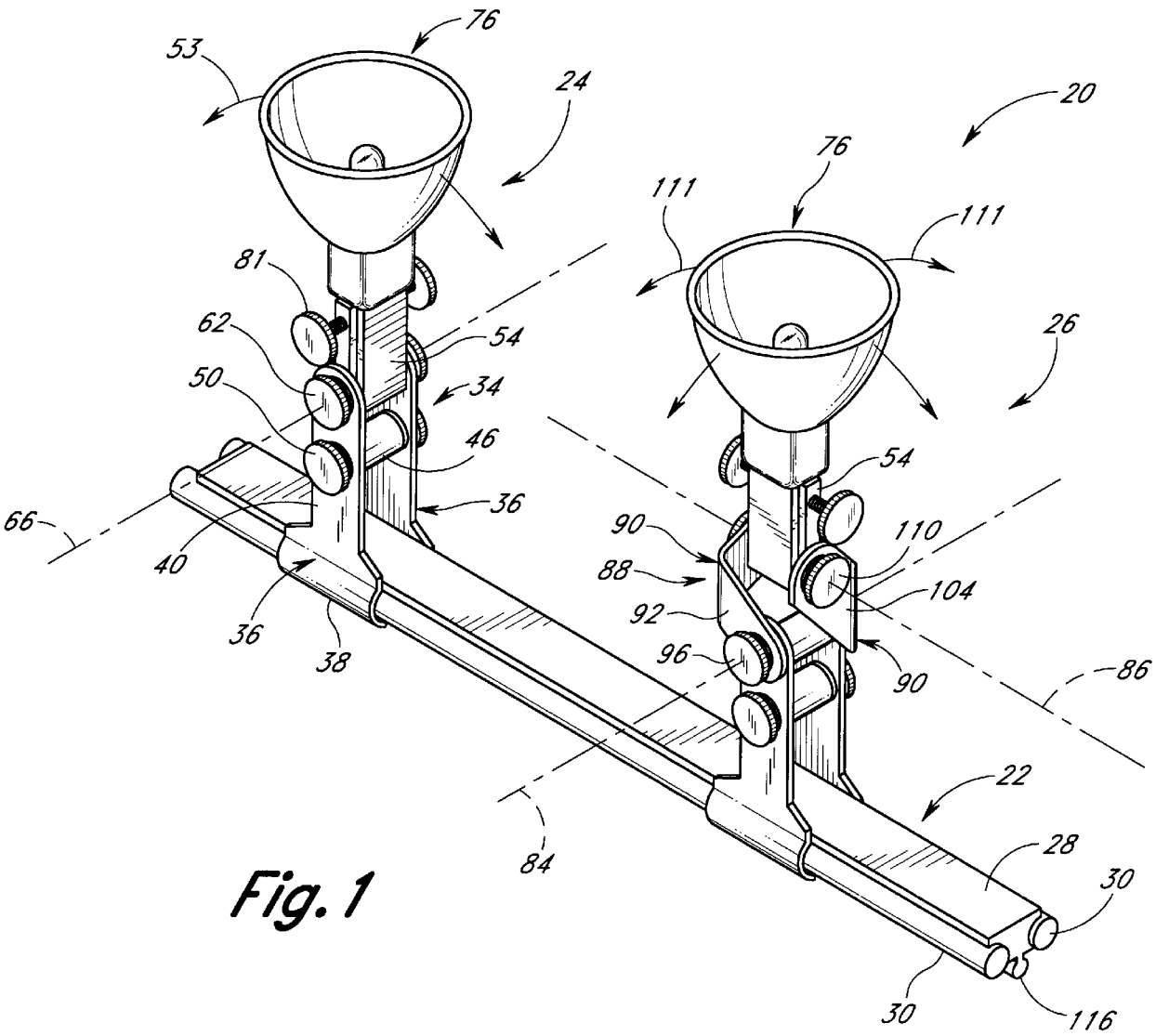
FIG. 1 is a perspective view of an extruded track lighting system of the present invention showing two different lamp mounting fixtures.

FIG. 1 illustrates a portion of an extruded track lighting system 20 comprising an elongated support rail 22 and a pair of mounting fixtures 24 and 26. As discussed in detail below, mounting fixture 24 enables single-axis rotation and mounting fixture 26 enables double-axis rotation. The support rail 22 is typically linear and provided in lengths of six feet or more, but may also include curvilinear sections or be provided in greater or smaller lengths. The support rail 22 comprises a central insulating extrusion 28 and a pair of parallel cylindrical electrical conductors 30.

Figure 4:
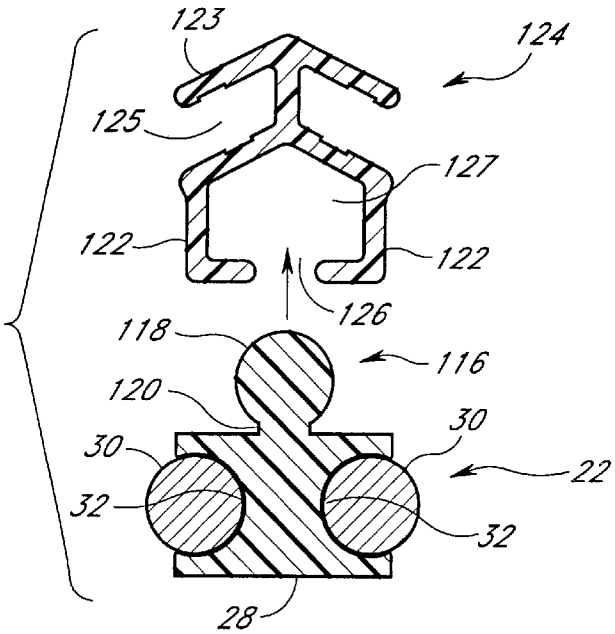
FIG. 4 is a cross-sectional view through a support rail having exterior conductors and a bracket into which the rail may be coupled.
Figure 5:
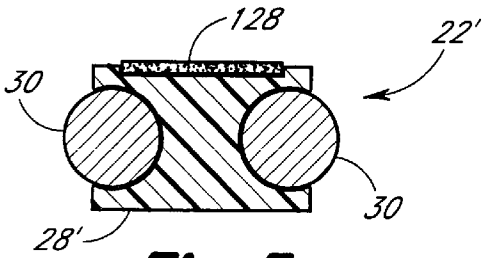
FIG. 5 is a cross-sectional view of an alternative support rail having exterior conductors.

As best seen in FIGS. 4 and 5, the extrusion 28 has a generally rectangular cross-sectional shape with a pair of elongated semi-cylindrical grooves 32 formed in opposed short sides of the rectangle. The grooves 32 receive the cylindrical conductors 30 and have approximately the same radius as the conductors. The grooves 32 have a depth such that the conductors 30 are retained securely therein and approximately half the cross section of each conductor is exposed on either side of the support rail 22. Preferably, the grooves 32 have a cross section which is slightly greater than a semicircle so that the opening to the groove is spaced apart a smaller distance than the diameter of the conductors 30 retained therein. The fixtures 24 and 26 shown in FIG. 1 are adapted to mount to the support rail 22, and the conductors 30 supply power thereto, as will be described below.

The extrusion 28 may be made from polypropylene or PVC, or any other such insulating material suitable for extrusion. In one particular embodiment, the extrusion 28 is made of GEON 8700A, produce by B. F. Goodrich, Inc. As will be described in more detail below, the extrusion is rigid enough to retain the conductors 30 in the grooves 32 even after being bent to relatively sharp angles. The conductors 30 may be a variety of materials, with copper being preferred for its high conductivity, low resistance.

In the illustrated embodiment, two fixtures, a single-axis mounting fixture 24 and a double-axis mounting fixture 26, are shown. Other variations of mounting fixtures may be provided, the two fixtures 24, 26 being representative only. Being operated at low voltages, the majority of elements making up the fixtures 24, 26 are advantageously highly electrically conductive, and can be fabricated from a general grade of steel or other conducting metal, although other non-metal conductive materials may be substituted. Preferably, the fixtures 24, 26 are constructed of Beryllium for its strength and conduction properties, and because it tends to age without discoloration.

Figures 2A, 2B:
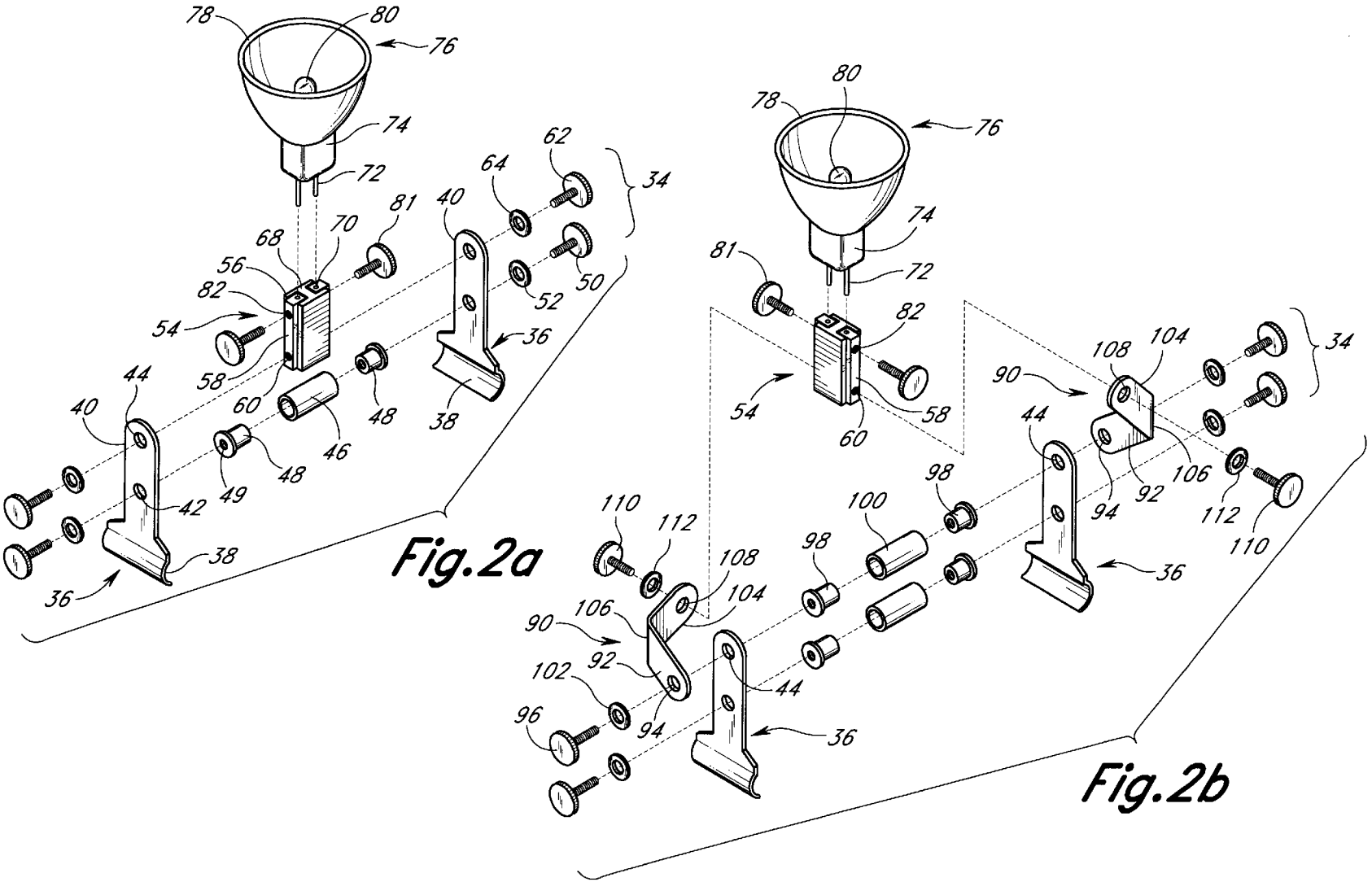
FIG. 2*a* is an exploded view of a single-axis mounting fixture of the extruded track lighting system.
FIG. 2*b* is an exploded perspective view of a double-axis mounting fixture of the extruded track lighting system.

With reference to the single-axis mounting fixture 24 shown in FIG. 1 and in the exploded view of FIG. 2*a,* a clamp bracket 34 comprising a pair of plate-like clamp legs 36 provides a coupling to the support rail 22. More particularly, the clamp legs 36 extending on either side of the support rail 22 have an arcuate portion 38 that conforms to the exterior shape of the opposed conductors 30. The clamp legs 36 extend perpendicularly from the longitudinal axis of the support rail 22 in a pair of flat parallel extensions 40. Each extension 40 includes a first aperture 42 disposed at approximately a midpoint of the extension, and a second aperture 44 disposed at a distal end of the extension farthest away from the support rail 22.

It should be noted here that the clamp legs 36 are identical and the description herein pertains to either side. Further, although the drawing may indicate element numbering for only one side, the same numbers apply to the opposite side. Therefore, for example, in FIG. 2*a* the right clamp leg 36 also includes the first and second apertures 42 and 44, respectively, even though they are not numbered.

Each clamp bracket 34 includes an insulating bushing 46 positioned between the clamp legs 36 and along a line through each of the first apertures 42. A pair of brass inserts 48 are press-fit into bores in opposed terminal ends of the insulating bushing 46, the inserts each having outwardly facing threaded bores 49 for receiving a threaded shaft of a thumb screw 50. The inserts 48 may be secured into the bushing 46 in other ways, and the term "press-fit" is intended to imply a fit which ensures the inserts will not separate from the bushings under even significant tensile load. The threaded shafts of each thumb screw 50 extend from the exterior of the respective clamp leg 36 through the first aperture 42 and into the threaded bore 49 of the adjacent insert 48. A compression washer 52 is positioned between the head portion of the thumb screw 50 and the outer surface of the clamp leg 36. The compression washer may be a Belleville-type, split-ring, or other such washer which provides an anti-rotation bias upon tightening and compression. Each of the threaded bores 49 has a depth dimensioned so that the associated thumb screw 50 is fully seated therein when the antirotation washer is compressed. That is, the thumb screw 50 is prevented from further rotation by bottoming out within the threaded bore 49, rather than solely from the contact of the head portion of the screw with the washer and clamp leg 36. This design, in conjunction with the anti-rotation washer, helps ensure the thumb screw 50 will not back out from the threaded bore 49 from jarring or other vibration.

The insulating bushing 46 and brass inserts 48 space the two clamp legs 36 apart a distance approximately equal to a width dimension of a block-shaped conducting member 54. The conducting member 54 comprises an insulator 56 having an H-shaped cross-section and a pair of elongated rectangular bar conductors 58 positioned therein. In this manner the rectangular conductors are electrically isolated from one another. A pair of swivel thumb screws 62 extend from either side of the clamp bracket 34 through the second apertures 44 in the clamp legs 36 and into threaded apertures 60 in the rectangular bar conductors 58. Again, a compression washer 64 is located between the head of the swivel thumb screw 62 and the exterior surface of each clamp leg 36, and the thumb screw is designed to bottom out in the threaded aperture 60. The shaft portions of the thumb screws 62 are in alignment and define a swivel axis 66 between the block-shaped conducting member 54 and the clamp bracket 34. Because the clamp bracket 34 is fixedly located extending perpendicularly away from the support rail 22, the conducting member 54 may swivel about the axis 66 (FIG. 1), which is shown extending perpendicularly with respect to the support rail.

To ensure a tight fit of the clamp bracket 34 about the support rail 22, the spacing between the facing concave surfaces of the arcuate portions 38 is slightly smaller than the distance across the opposed conductors 30 when mounted in the extrusion 28. In this regard, the insulating bushing 46 positioned between the clamp legs 36 determines the spacing of the arcuate portions 38. The insulating bushing 46 may be sized the same as the block-shaped conducting member 54 to hold the flat extensions 40 apart in parallel, or the bushing may be undersized so as to cause the extensions 40 to slightly converge toward the support rail 22. In either situation, tightening the thumb screws 50 clamps the flat extensions 40 to the insulating bushing 46. The present clamp bracket 34 and support rail 22 are designed to enable easy coupling and removal. The geometry of the clamp legs 36 and there resiliency allows the bracket 34 to be simply "snapped" into place on the support rail 22 by forcing the the resilient clamp legs 36 to spread apart a slight amount. The springback of the clamp legs 36 is sufficient to firmly hold the bracket to the rail. The advantageous method of removing the bracket from the rail is shown in detail in FIGS. 14*a–c*.

Advantageously, given the geometry of the support rail, the clamp bracket 34 is firmly held extending therefrom in one direction, without risk of swiveling around the rail in case of vibration, or even upon inadvertent loosening of the bracket. The conducting member 54 provides a spacer for ends of the clamp legs 36 opposite the arcuate portions 38 to enhance the clamping action of the thumb screws 50 and flat extensions 40 around the insulating bushing 46. That is, the conducting member 54 and support rail 22 provide spacers on opposite ends of the clamp legs 36 forming a clamping bridge therebetween in which area the thumb screws 50 act.

The conducting member 54 extends distally away from the swivel axis 66 and terminates in an end surface 68. A pair of dead-end sockets 70 are provided in the end surface 68. More particularly, one socket 70 is provided in each of the rectangular bar conductors 58. The sockets 70 receive conducting prongs 72 extending from a base 74 of a lamp 76. The lamp 76 is of a conventional type which includes a reflector 78 and a bulb 80; the bulb receiving electricity through the base 74 from the prongs 72. The lamp 76 is preferably a miniature halogen light, although other lights or electrical devices can be substituted. A pair of lamp tightening set screws 81 extend into threaded apertures 82 on either side of the conducting member 54. The apertures 82 open into the sockets 70 so that the shaft portions of the screws 81 come into contact with the prongs 72. By tightening the set screws 81, the prongs 72 can be retained within the sockets 70.

With the single-axis mounting fixture 24 assembled, the lamp 76 may be rotatably oriented about the axis 66, as indicated with the arrows 53, in a plane aligned with the support rail 22 (that is, of course, unless the support rail is curved). The swivel thumb screws 62 can be loosened to allow orientation of the lamp 76. The compression washers 64 enable the lamp 76 to be securely oriented with respect to the support rail 22 without extreme torque needed. The tightening screws 81 allow the lamp 76 to be replaced when the bulb 80 burns out.

Referring to FIG. 1, the double-axis mounting fixture 26 includes the clamp bracket 34, as described for the single-axis mounting fixture 24, and also includes the block-shaped conducting member 54 leading to the conventional lamp 76. Between the clamp bracket 34 and the conducting member 54, a universal joint 88 is provided, which allows the lamp 76 to rotate with respect to the support rail 22 about a first swivel axis 84 and a second swivel axis 86.

With reference to FIG. 2*b,* the universal joint 88 comprises a pair of irregularly shaped brackets 90. Each irregular bracket 90 comprises a first planar portion 92 having an aperture 94 therein. A swivel thumb screw 96 extends through the aperture 94, through the upper aperture 44 in the clamp leg 36, and into a brass insert 98 of an insulating bushing 100. The insulating bushing 100 extends between the clamp legs 36 of the aforementioned clamp bracket 34 and provides a spacer for ends of the clamp legs 36 opposite the arcuate portions 38 to enhance the clamping action of the thumb screws 50 and flat extensions 40 around the insulating bushing 46. Again, a compression washer 102 is provided between the head of each swivel thumb screw 96 and an exterior surface of the first planar portion 92 of each irregular bracket 90. The swivel thumb screws 96 and brass inserts 98 are aligned along the first swivel axis 84 to enable each of the irregular brackets 90 to pivot about axis 84 with respect to the clamp bracket 34 and support rail 22. Each of the swivel thumb screws 96 bottoms out within the brass inserts 98 for secure fastening.

Each of the irregular brackets 90 comprises a flat member bent 90° at a bend 106 and further comprises a second planar portion 104 joined to the first portion 92 at the bend. The first and second portions 92, 104 are also angled approximately 120° with respect to one another. That is, a line in the longitudinal direction of the second portion 104 defines a 120° angle with respect to the plane of the first portion 92. This enables the irregular brackets 90 to extend generally perpendicularly from the first swivel axis 84 and angle upward (as seen in FIG. 1) from the first swivel axis to define the second swivel axis 86.

More particularly, apertures 108 are provided in the distal end of each second portion 104, the apertures being aligned with and surrounding the previously described threaded apertures 60 of the conducting member 54. Swivel thumb screws 110 and compression washers 112 complete the coupling between the irregular brackets 90 and the conducting member 54. By loosening and retightening the swivel thumb screws 96 and 110, the lamp 76 may be oriented about the first and second swivel axes 84 and 86 with respect to the support rail 22, as indicated by arrows 111 (FIG. 1).

Figure 3:
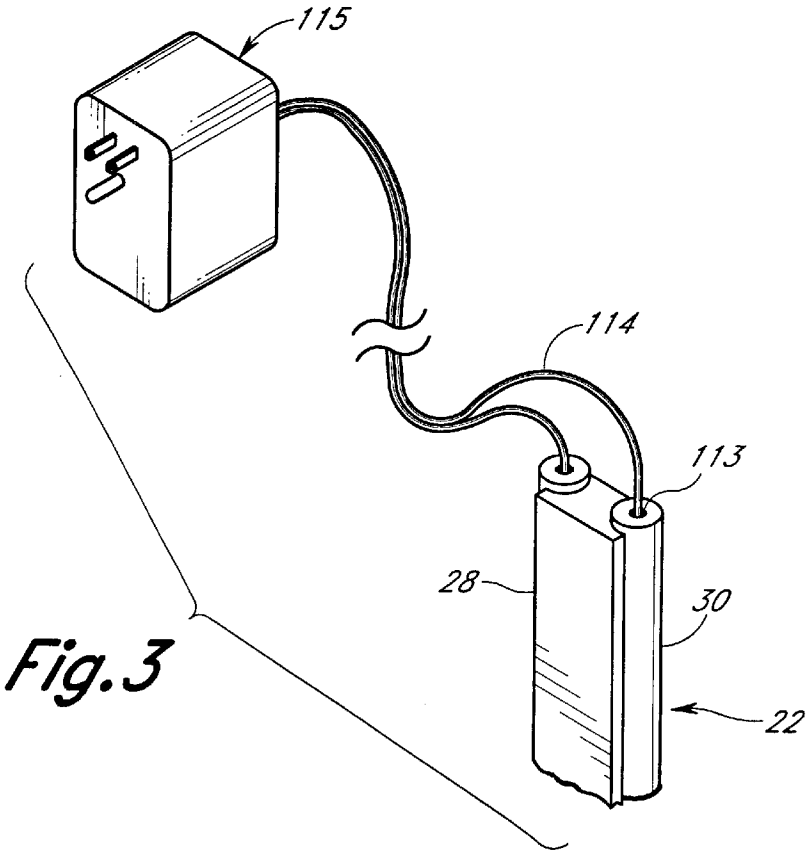
FIG. 3 is a schematic perspective view of a power supply end of a support rail of the extruded track lighting system.

An important feature of the present invention is the simplified and reliable conductance path from the support rail 22 through the fixtures 24, 26 to the lamps 76. Looking at FIG. 3, a power supply end of the rail 22 includes a pair of short bores 113 formed along the axis of each conductor 30 which receive power leads 114. In the illustrated example, the leads 114 terminate in a conventional electrical transformer plug 115 which converts standard 120 VAC into 12 VAC. In one example, power is supplied to the conductors 30 at 12 VAC and 200 W; the specific wattage being variable depending on the number of lamps 76 to be powered. Of course, those of skill in the art will realize a suitable AC voltage can be supplied to the leads 114 in any number of ways, including wired-in arrangements. Furthermore, as will be apparent to one of skill in the art, dimmers can be provided to vary the intensity of the lamps attached along the support rail 22.

Current conducts along the rails when a circuit is made at one or more fixtures 24, 26. With reference to FIGS. 1 and 2*a,* it will be apparent that the electrical circuit for single swivel axis fixture 24 travels directly through the clamp legs 36 and rectangular bar conductors 58 to the lamp prongs 72, the clamp legs 36 and rectangular bar conductors 58 being made of conducting materials and being in intimate contact. With reference to FIGS. 1 and 2*b,* the electrical circuit for double swivel axis fixture 26 travels directly through the clamp legs 36, irregular brackets 90 and rectangular bar conductors 58 to the lamp prongs 72. In this case, the clamp legs 36 and irregular brackets 90, and the irregular brackets 90 and rectangular bar conductors 58, respectively, are in intimate contact, and are made of conducting materials. Of course, there can be relative sliding between each of these pairs of conducting bridge surfaces in intimate contact to enable the various orientations of the lamps 76. However, a minimum of torque applied to the various thumb screws is needed to ensure the respective brackets remain oriented properly, due to the compression washers. This simultaneously ensures an adequate electrical connection.

Figure 6:
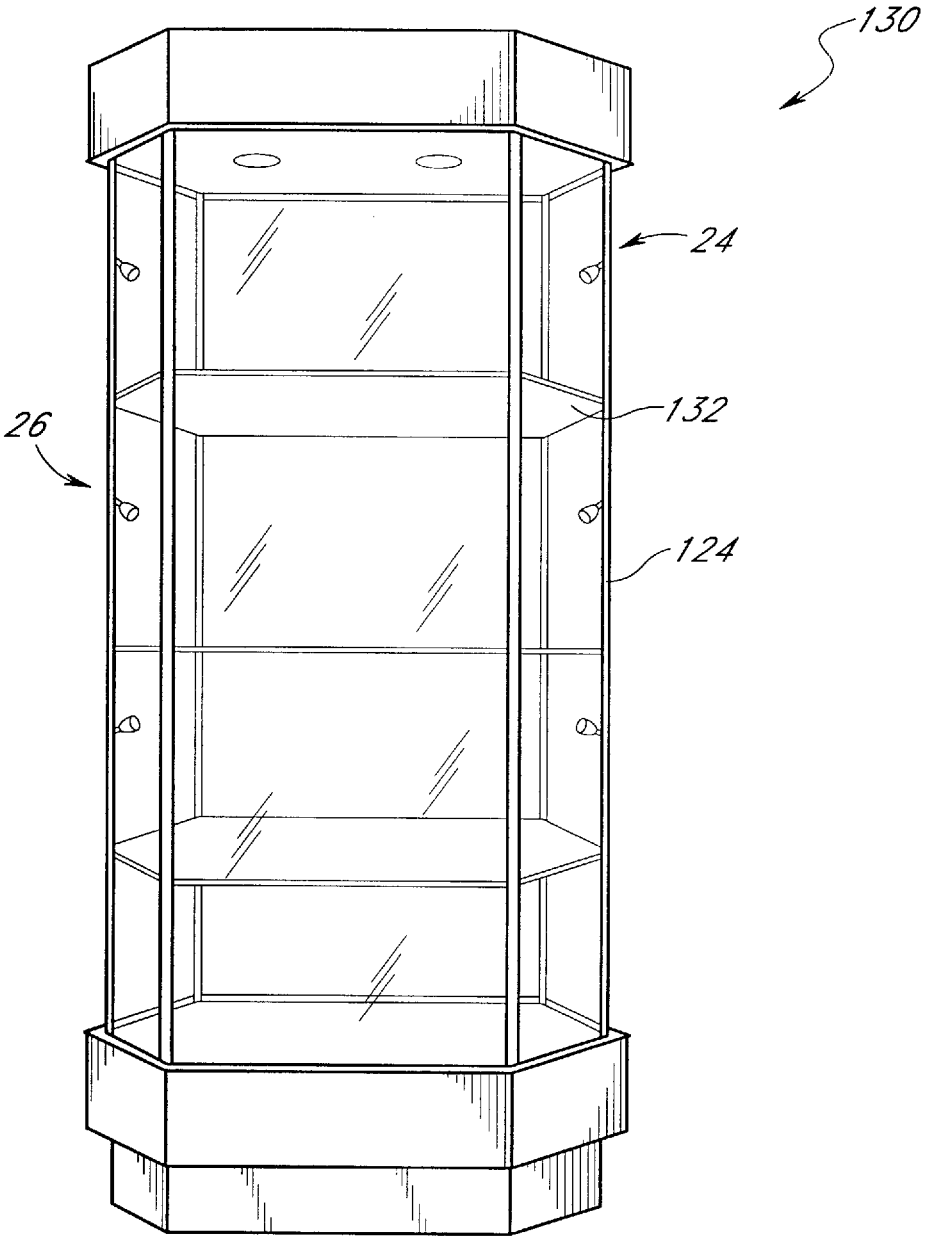
FIG. 6 is a perspective view of a display cabinet with an extruded track lighting system of the present invention installed therein.

FIGS. 4 and 5 illustrate two alternative ways to fasten the support rail 22 within, for example, a display cabinet 130, seen in FIG. 6. The middle portion of the frame of the cabinet 130 may be formed by a number of vertical brackets 124 having suitable channels 125 for receiving and supporting glass panes forming the sides of the cabinet. In the illustrated embodiment, the channels 125 define an included angle of about 120° to form a corner for a six-sided cabinet 130. Of course, brackets on which to mount the support rail 22 are not limited to the particular version shown, and the cabinet may be rectangular or other shape. The brackets 124 are typically aluminum extrusions. Horizontal supports or pegs (not shown) fasten to the brackets 124 at spaced vertical intervals and support shelves 132 in the cabinet 130. Additionally, one or more support rails 22 are fastened vertically within the cabinet 130 to provide elongated mounting locations for a plurality of light fixtures 24, 26, a representative distribution of which is shown.

FIG. 4 shows a cross section through a preferred embodiment of the support rail 22 having an extrusion 28 with an elongated rib 116 provided thereon. The rib 116 is formed with a nearly complete cylindrical portion 118 joined to the generally rectangular extrusion 28 at a neck 120. The rib 116 is adapted to extend between a pair of opposed legs 122 of the cabinet brackets 124. More specifically, the legs 122 form an opening 126 into a cavity 127 and are spaced apart a distance which is smaller than the diameter of the cylindrical portion 118 of the rib 116. The rib 116 can be forced through opening 126 past the resilient opposed legs 122 and into the cavity 127. The terminal ends of the legs 122 reside adjacent the neck 120. This enables the support rail 22 to be mounted to the inside edge of the cabinet frame bracket 124 without additional fastening means. In FIG. 6 the cabinet includes six vertical brackets 124, four of which in a rectangular configuration have pegs for supporting the shelves 132. The two outermost side brackets 124 each receive the rib 116 of a support rail 22 to provide a vertical array of light fixtures 24, 26 on opposite sides of the cabinet 130.

FIG. 5 illustrates an alternative embodiment of a support rail 22'. In this embodiment the generally rectangular extrusion 28' has an elongated patch of double-faced tape 128 applied thereto in place of the elongated rib 116. The double-faced tape 128 can be used to stick the support rail 22 to any suitable dry, flat surface. In rectangular cabinets having only four frame brackets 124, the support rail 22' is applied to the inner surface of the cabinet glass in a variety of positions, often adjacent and parallel to one of the vertical brackets 124.

Figure 7:
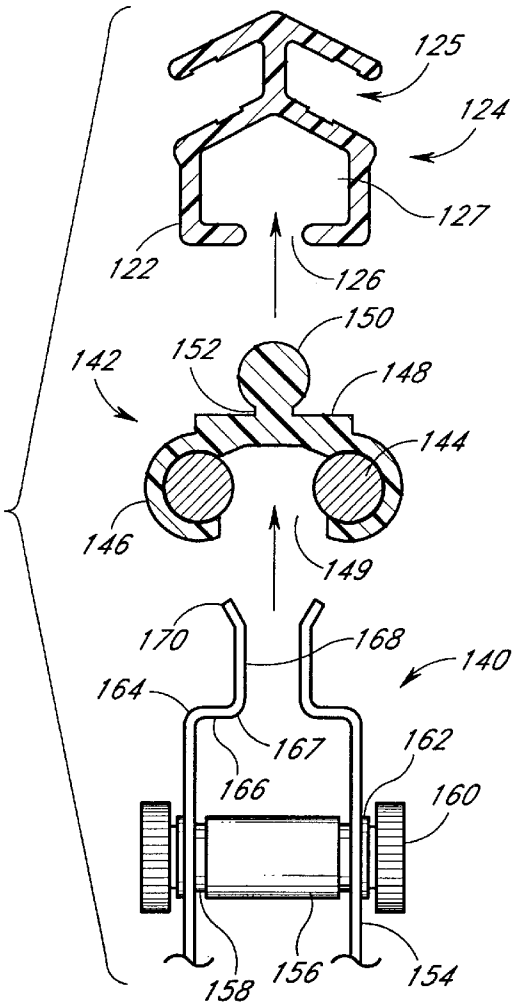
FIG. 7 is an exploded sectional view through a support rail having interior conductors and a lamp mounting fixture, and a bracket into which the rail may be coupled.

FIG. 7 shows an exploded sectional view through an alternative clamp bracket 140, an extruded track 142 having interior conductors 144, and bracket 124. The bracket 124 is identical to that described above and includes the legs 122 and channels 125 for glass sides of a display cabinet, for example. The clamp bracket 140 may include single- or double-axis swiveling hardware as described above, or may provide a track mount for a number of other fixtures, although only the portion for coupling with the track 142 is shown.

The modified extruded track 142 includes a pair of curvilinear arms 146 projecting from a common base portion 148. The arms 146 extend substantially around conductors 144 retained therewithin and terminate facing each other forming an opening 149. The conductors 144 are spaced apart a first distance. On the opposite side of the base 148, an elongated rib is formed with a nearly complete cylindrical portion 150 joined to the base portion 148 at a neck 152. The rib 150 is adapted to extend and be retained between the legs 122 of the bracket 124, as described in the embodiment of FIG. 4. The modified clamp bracket 140 is adapted to insert between the arms 146 and into contact with the conductors 144.

The clamp bracket 140 includes a pair of conductive legs 154 spaced apart by an insulating bushing 156. As with the first embodiment, brass inserts 158 press-fit into the ends of the bushing 156 receive shafts of thumb screws 160. Lock washers 162 are provided between the head of the thumb screws 160 and the legs 154. The legs 154 extend in parallel and transition to short coplanar portions 166 at bends 164. Secondary bends 167 lead to short parallel portions 168 terminating in slightly outwardly angled tangs 170. The tangs 170 are spaced apart a second distance smaller than the opening 149 between the arms 146, yet slightly larger than the first distance between the conductors 144. The parallel portions 168 are also spaced apart slightly greater than the first distance between the conductors 144 to ensure a good electrical connection therebetween.

Figure 8:
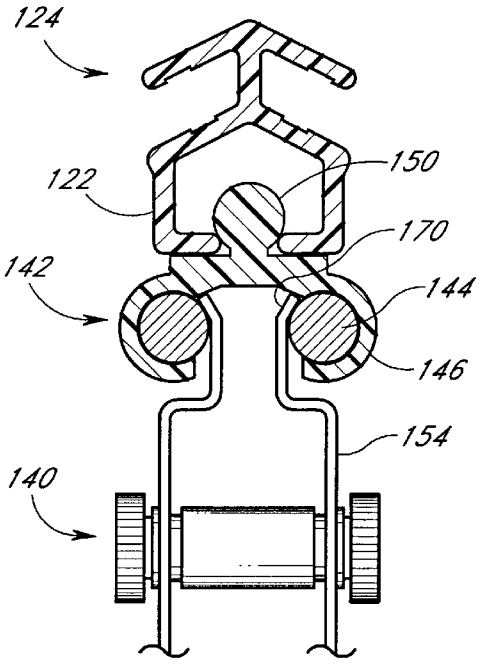
FIG. 8 is a sectional view through the assembled support rail having interior conductors and mounting fixture of FIG. 7 installed in the bracket.

FIG. 8 illustrates the assembly of the clamp bracket 140, extruded support rail 142, interior conductors 144 and bracket 124. The tangs 170 reside within a small space within the extruded track cavity and are restricted therein by the conductors 144. To insert or remove the clamp bracket 140 from the extruded track 142, the tangs 170 are forced inward toward each other upon contact with the cylindrical conductors 144. The conductive legs 154 are resilient to spring inward to allow the tangs 170 past the conductors 144, yet maintain a positive outward bias to firmly couple the clamp to the track 142. As with the first embodiment, the clamp bracket 140 is retained in a fixed orientation with respect to the track 142 without possibility of swiveling therearound.

Figure 9:
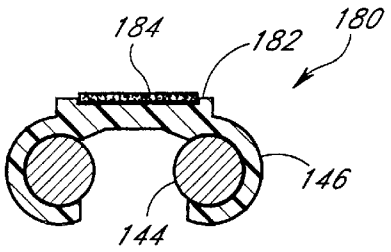
FIG. 9 is a sectional view through an alternative support rail having interior conductors.

An alternative extruded track 180 seen in FIG. 9 includes the arms 146 as described above for receiving interior conductors 144. The arms 146 extend from a modified, generally flat base portion 182 having a rear channel for receiving double-sided tape 184. Such an extrusion may easily be attached to any suitable flat surface, such as the inner glass sides of a cabinet, the small size of the track and attached light fixtures insuring a secure connection using the tape 184.

The support rails of the present invention may be provided in straight or bent sections by the manufacturer or retailer to meet the aesthetic or geometric design needs of their customers. Indeed, the provision of a relatively small cross-section and flexibility of the conducting rods make forming the support rails into various shapes relatively easy. The polypropylene or PVC material used for the extrusion is nominally rigid, but will bend upon sufficient application of force without fracture, at least in static situations. The conductors are desirably copper or other metallic conductor, which assumes the shape into which it is bent with only a slight elastic spring back. In other words, an assembled support rail may be bent beyond its yield strength to enable plastic material deformation without exceeding the ultimate strength.

Figure 10:
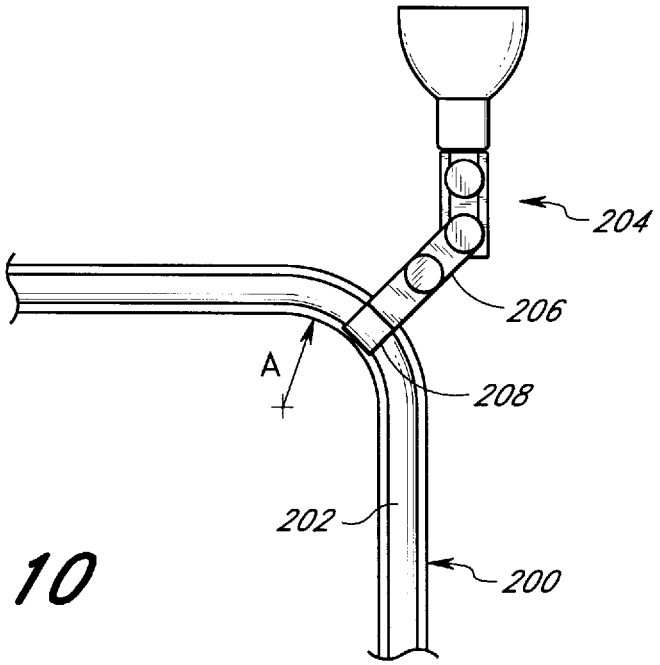
FIG. 10 is a side elevational view of a section of support rail having exterior conductors bent in a plane of symmetry between the conductors and showing a single-axis mounting fixture attached to the rail in the region of the bend.

In FIG. 10, a section of support rail 200 having exterior conductors 202 is seen bent about an axis having an inner radius A. The bending plane lies along the plane of symmetry between the cylindrical conductors 202, so that the conductors assume identical radii of curvatures. A single-axis lighting fixture 204 having clamp legs 206 with arcuate gripping portions 208 is shown attached to the outer side of the bent portion of the rail 200. This fixture 204 is the same as shown in FIG. 1. The radius A is such that the clamp legs 206 may securely hold the fixture 204 to either the inner or outer side of the bent rail 200. That is, although the conductors 202 to which the legs 206 clamp are curved, as opposed to straight as is the rounded cavity formed by the facing arcuate portions 208, the curvature is not so great that the arcuate portions cannot form a grip on the rail 200. A minimum radius of curvature A to ensure a secure grip of the clamp legs 206 is about $^{11}/_{16}$ (0.6875) inch for rails having 0.185 inch diameter conductors 202. The rail 200 may be bent to precise configurations using bending tools, or may be bent by hand about the plane of symmetry between the conductors 202.

Figure 11:
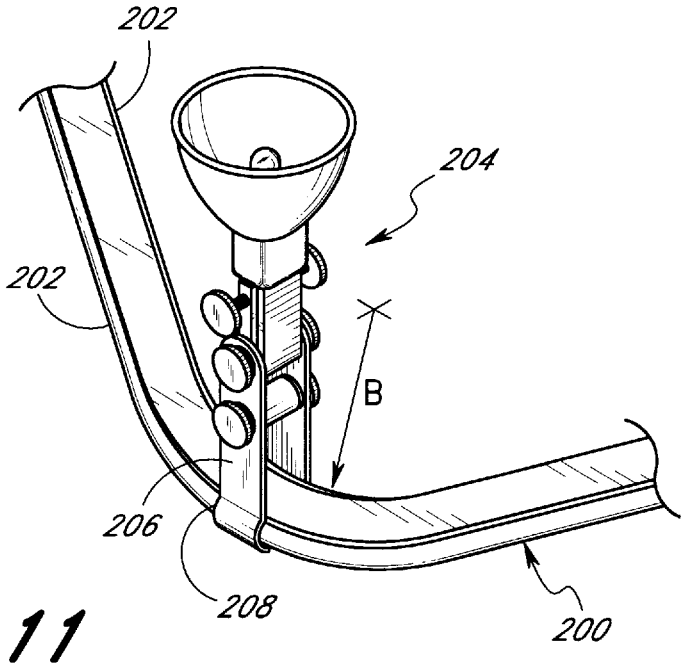
FIG. 11 is a perspective view of a section of support rail having exterior conductors bent in a plane through the axes of the conductors and showing a single-axis mounting fixture attached to the rail in the region of the bend.

In FIG. 11, a section of support rail 200 having exterior conductors 202 is seen bent about axis having an inner radius B. The bending plane lies in a plane in intersecting the axes of the conductors 202, so that the conductors assume different radii of curvatures. The single-axis lighting fixture 204 having arcuate gripping portions 208 is shown attached to one side of the bent portion of the rail 200. The fixture 204 could be attached to the either side of the curved portion of the rail 200; the radius B being such that the clamp legs 206 securely hold the fixture 204 to either side. A minimum radius of curvature B to ensure a secure grip of the clamp legs 206 is about 1⅞ (1.875) inch for rails having 0.185 inch diameter conductors 202. The rail 200 is preferably bent using tools rather than by hand about the plane through the axes of the conductors 202, because of the higher bending strength in that plane.

Figure 12:
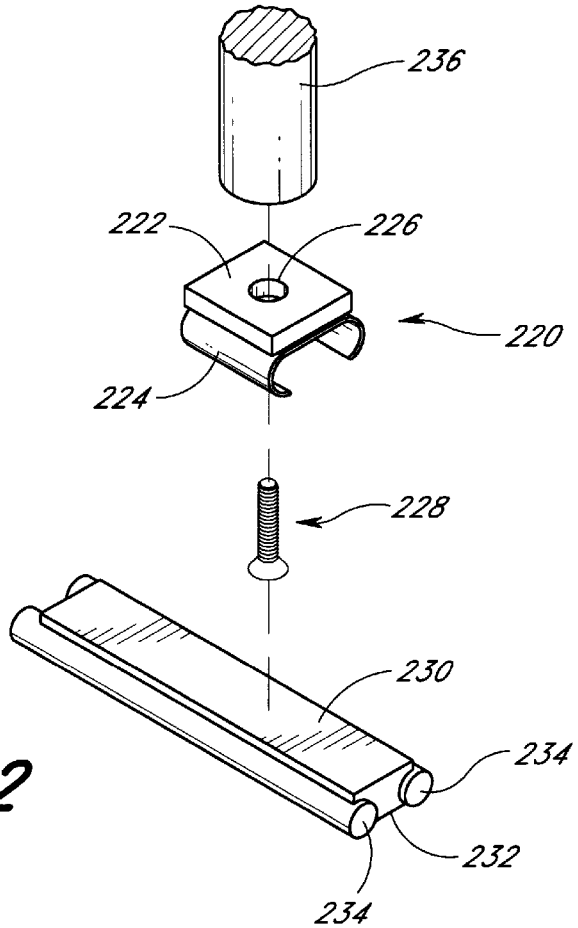
FIG. 12 is an exploded perspective view of one type of screw-mounted tile for mounting the support rail having exterior conductors.

The present extruded track lighting system 20 is suitable for illuminating many environments. As such, there are numerous means for supporting the extruded track, in addition to the cabinet systems and double-sided tape configurations previously described. In one such mounting configuration, seen in FIG. 12, a mounting tile 220 comprises a base 222 and a pair of electrically insulating opposed curved walls 224. The base 222 includes a though hole 226 sized for receiving a mounting screw 228. The screw 228 may be installed on the ends of drop tubes 236, or attached to flat walls or ceiling surfaces. The curved walls 224 together define an elongated channel within which a support rail 230 having an insulating extrusion 232 and exterior conductors 234 may be snapped. That is, the curved walls 224 are spaced apart approximately the same distance as the outwardly facing conductors 234 to allow simple, secure installation and easy removal. Besides the curved walls 224, the base 222 is also advantageously constructed of a non-conductive material, such as the insulating material used to form the extrusion 232. The screw mounting arrangement is only one of many possible, and those of skill in the art will recognize that others may be substituted. For example, the rear of the base 222 may include a layer of double-sided tape as was previously described for the extrusion itself.

Figure 13:
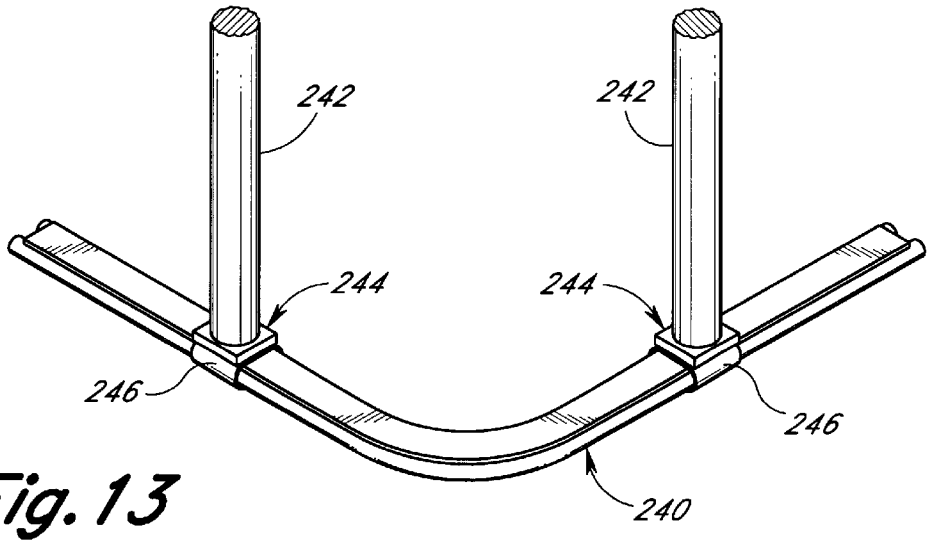
FIG. 13 is a perspective view of a suspension-type support system for the support rail having exterior conductors.

One example of a special mounting arrangement is shown in FIG. 13. A support rail 240 is seen suspended below a plurality of drop tubes 242. The terminal ends of the tubes 242 include tiles 244 having opposed curved walls 246, similar to those shown in FIG. 12. The rail 240 is shown bent so that the tiles 244 of two sequential tubes 242 are misaligned. To facilitate such configurations, the tiles 244 may swivel on the tubes 242 allowing variable alignment of the curved walls 246 with the particular section of rail 240. Also, other vertical supports, such as cables and the like, in combination with the tiles are possible.

Figure 14C:
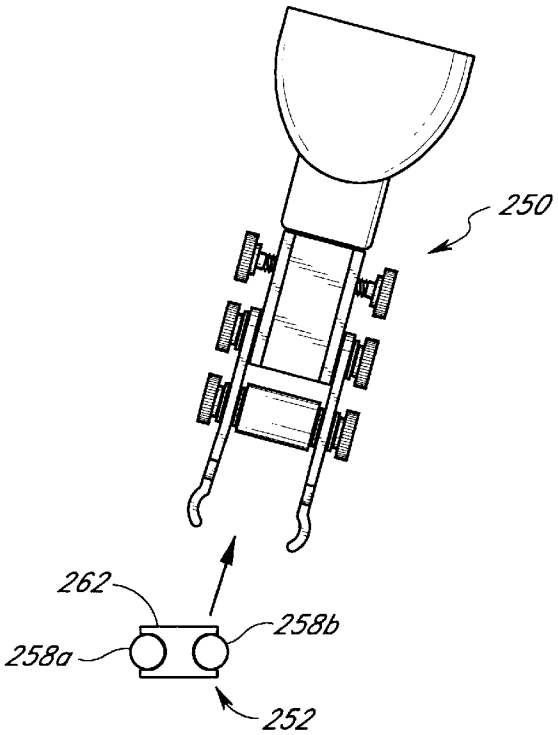
FIGS. 14*a–c* are elevational views looking along the support rail and showing a sequence of steps for removing a lighting fixture by rotation about the rail.
Figure 14B:
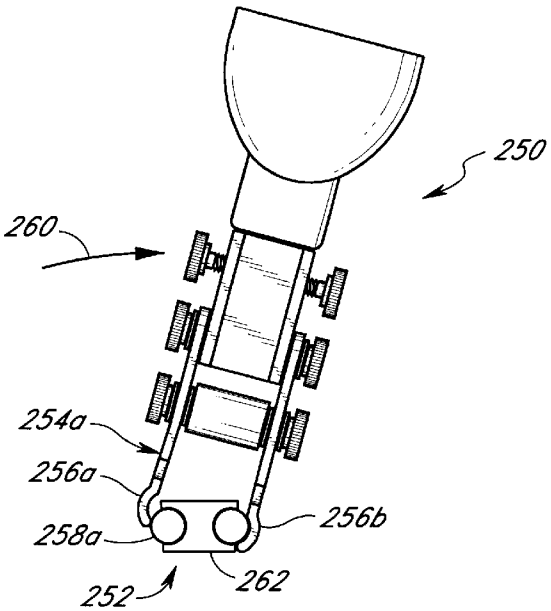
Figure 14A:
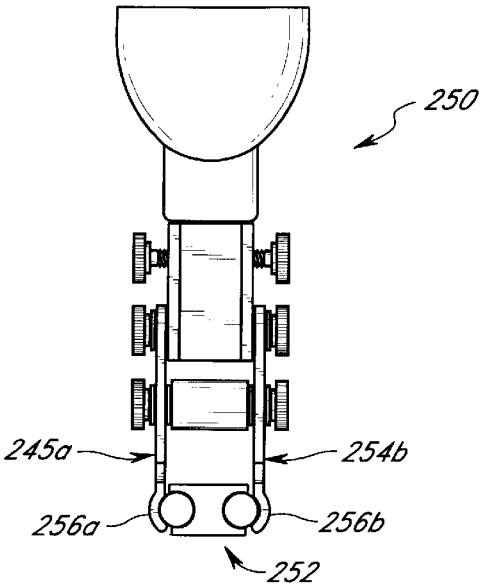

A significant feature of the present invention, as mentioned above, is a track lighting system having a support rail and light brackets which are very easy to both mount and remove. FIGS. 14*a–c* illustrate a basic sequence of removing a lighting bracket 250 from a support rail 252. The bracket 252 includes opposed clamp legs 254*a,* 254*b* with arcuate portions 256*a,* 256*b,* as described previously. The arcuate portions 256 extend in an arc which enables the bracket 250 to be snapped on and off opposed conductors 258 held in grooves in the extrusion 262 with little difficulty. That is, each arcuate portion 256 extends in an arc of between 10° and 45°, and preferably in an arc of approximately 30°. The spacing between the arcuate portions 256*a, b,* on the other hand, is less than the distance across the outwardly facing surfaces of the conductors 258*a,b* and the legs 254*a,b* firmly hold the bracket to the support rail by virtue of the elastic material of the legs.

The bracket 250 is easily put on and removed from the rail 252 by a simple twisting motion. Thus, as seen in FIG. 14*b,* a rotational force 260 is applied to the bracket 250. As the arcuate portion 256*b* on the right rotates about the right conductor 258*b,* the left clamp leg 254*a* begins to be pulled off the left conductor 258*a* because of the offset axes of the conductors. When the distal tip of the left arcuate portion 256*a* cams over the generatrix of the left conductor 258*a* (FIG. 14*b*), the clamp legs 254*a,b* are spread apart the farthest. Finally, the bracket 250 separates from the rail 252 in FIG. 14*c* and the clamp legs 154*a,b* spring inward. The bracket 250 is preferably coupled to the rail 252 using the reverse sequence of steps. The force (applied as a torque) required to couple or separate the bracket from the rail is thus considerably less than that required to directly push or pull the bracket onto or from the rail. This reduces the work in installing and positioning large numbers of brackets, and also reduces the forces transmitted to the support rails and associated mounting hardware to help avoid breakage of those sometimes fragile components.

The support rail with interior conductors and associated brackets shown in FIGS. 7–9 also provides the easy swiveling installation and removal as just described. The difference is that instead of the clamp legs of the bracket being spread apart they are forced together to pass the tangs between the interior conductors.

Although this invention has been described in terms of certain preferred embodiments, other embodiments that are apparent to those of ordinary skill in the art are also within the scope of this invention. Accordingly, the scope of the invention is intended to be defined by the claims that follow.

What is claimed is:

1. A lighting system, comprising:

a support rail having a pair of parallel spaced cylindrical conductors separated by an insulating member, said conductors being at least partially exposed and accessible from an exterior location;

a bracket adapted to clamp to said conductors, said bracket having a pair of conductive clamp legs sized and configured to conform to said exposed portions of said conductors;

a spacer positioned between said clamp legs; and a lamp mounting fixture positioned between said clamp legs and having conductive members in communication with said clamp legs and mounted to rotate about an axis, wherein said bracket clamps to said support rail and rotation of said bracket about said support rail is constrained therefore, and wherein electricity from said conductors may conduct directly through said bracket clamp legs to said fixture conductive members to provide power to an associated lamp.

2. The system of claim 1, wherein said lamp mounting fixture comprises a rigid insulating body having an H-shaped cross section.

3. The system of claim 2, wherein said pair of conductive members comprise elongated rectangular bars separated by said insulating body.

4. The system of claim 1, wherein said spacer comprises a bushing having a bore which aligns with a first pair of apertures respectively formed on said pair of clamp legs, and a first pair of fasteners which can be inserted through said bore and said first pair of apertures, to clamp together juxtaposed surfaces of said clamp legs by tightening said fasteners.

5. The system of claim 4, wherein said conductive members have threaded bores which align with a second pair of apertures respectively formed on said pair of clamp legs, and a second pair of fasteners which can be inserted through said conductive member bores and said second pair of apertures, to clamp together juxtaposed surfaces of said clamp legs by tightening said fasteners.

6. The system of claim 4, wherein said spacer further comprises inserts pressed into dead-end cavities in terminal ends of said bushing, said inserts providing threaded bores to receive said first fasteners.

7. The system of claim 6, wherein said inserts are brass.

8. The system of claim 1, wherein said clamp legs face each other and clamp around said cylindrical conductors, said clamp legs being spaced apart slightly less than said spaced cylindrical conductors by virtue of the size of said spacer to provide a clamping action.

9. The system of claim 1, wherein said clamp legs face away from each other and clamp against said cylindrical conductors, said clamp legs being spaced apart slightly greater than said spaced cylindrical conductors by virtue of the size of said spacer to provide a clamping action.

10. The system of claim 5, further comprising a second spacer having a bore which aligns with a third pair of aligned apertures respectively formed on said pair of clamps legs, and a third pair of fasteners which can be inserted through said second spacer and said third pair of apertures, to clamp together juxtaposed surfaces of said clamp legs by tightening said fasteners into the bore of said second spacer so that said lighting system may rotate about an axis through said first and third pair of apertures, said first and third pairs of apertures being aligned through non-parallel axes so that said fixture may swivel in two planes.

11. The system of claim 10, wherein at least one of said first or second spacers further includes inserts pressed into dead-end cavities in terminal ends of said spacer, said inserts providing threaded bores to receive a pair of threaded fasteners.

12. The system of claim 10, wherein said concave portions face each other and clamp around said exterior exposed conductors, said concave portions being spaced apart slightly less than said spaced conductors by virtue of the sizes of said second bushing and said spacer between said clamp legs to provide said clamping action.

13. A system of tracked lights, comprising:

a support rail having a pair of parallel spaced cylindrical conductors separated by an insulating member, said conductors being at least partially exposed and accessible from an exterior location;

a bracket having a pair of conductive clamp legs with concave portions that conform to an exposed portion of said conductors adapted to clamp to said conductors, said bracket having two pairs of aligned apertures said first pair being on an end of said bracket opposite said concave portions and said second pair being intermediate said first pair and said concave portions;

a spacer positioned between said clamp legs and having a threaded bore aligned with said first pair of apertures;

a plurality of fasteners having threaded shafts adapted to engage said threaded bore, two of said fasteners being inserted through said second pair of apertures to clamp inner surfaces of said clamp legs to said spacer; and a lamp mounting fixture positioned between said clamp legs and having conductive elements in communication with said clamp legs and mounted with two of said fasteners to rotate about an axis through said first pair of apertures, wherein said bracket clamps to said support rail and rotation of said bracket about said support rail is constrained therefore, and wherein electricity from said conductors may conduct directly through said bracket clamp legs to said fixture conductive members to provide power to an associated lighting fixture.

14. The system of claim 13, further comprising a second bushing positioned between the clamp legs having outwardly facing threaded bores aligned with a third pair of apertures formed on said bracket so that said lighting system may rotate about an axis through said first and third pair of apertures, said first and third pairs of apertures being aligned through non-parallel axes so that said fixture may swivel in two planes.

15. A kit for a track lighting system, comprising:

a flexible extruded member having a pair of elongated grooves formed on opposing sides of said member;

at least two cylindrical conductors sized and configured to be received into said grooves;

a bracket having a pair of conductive clamp legs with concave portions that conform to the exposed portions of the conductors; and at least one lamp mounting fixture having an insulating body and conductive members comprising elongated rectangular bars sized and configured to be mounted in electrical communication with said clamp legs and so as to rotate with respect to said bracket.

16. A support rail for use in a track lighting system, comprising:

an elongated extruded insulator having a base portion and a pair of partial cylindrical grooves, said insulator being plastically flexible so as to be able to bend and be arranged non-linearly;

a pair of cylindrical conductors held within said grooves and separated by said base portion said conductors being at least partially exposed and accessible from an exterior location; and an elongated mounting rib joined to said insulator base at a neck and to be forced between a pair of resilient opposed legs of a mounting frame to mount a length of said support rail.

17. The system of claim 16, wherein said extrusion grooves face outwardly and said conductors are exposed on an exterior of said support rail.

18. The system of claim 16, wherein said extrusion grooves face inwardly and said conductors are exposed on an interior of said support rail.

19. A track lighting system, comprising:

a flexible support rail having a pair of parallel spaced cylindrical conductors separated by an insulating extruded member, said conductors being at least partially exposed and accessible from an exterior location;

a bracket adapted to clamp to said conductors, said bracket having a pair of conductive clamp legs with concave portions that conform to and clamp against said exposed portion of said conductors in either straight and bent regions of said support rail; and a lamp mounting fixture having conductive members adapted to be mounted in communication with said clamp legs and to rotate with respect to said bracket, wherein said concave portions of said bracket is sized and configured to clamp to said support rail and rotation of said bracket about said support rail is constrained by at least one fastener, and wherein electricity from said conductors may conduct directly through said bracket clamp legs to said fixture conductive members to provide power to an associated lamp.

20. The track lighting system of claim 19, wherein said extruded member has a base portion and a pair of partial cylindrical grooves for receiving said conductors.

21. The track lighting system of claim 19, wherein said extruded member is constructed of Poly Vinyl Chloride (PVC).

22. The track lighting system of claim 19, wherein said extruded member is constructed of polypropylene.

23. The track lighting system of claim 19, wherein an extrusion groove faces outwardly and each of said cylindrical conductors are exposed on an exterior of said support rail, said system further including:

a plurality of tiles for clamping to said exposed conductors having a base portion and a pair of opposed arcuate portions adapted to snap around said conductors.

24. The track lighting system of claim 23, further including a plurality of suspension elements on the end of which said tiles are pivotably mounted.

25. A method of configuring a track lighting system by mounting at least one lamp fixture in a fixed position with respect to a rail, comprising the steps of:

mounting a support rail to a location fixed with respect to a reference frame, said support rail having a pair of parallel elongated conductors having exposed arcuate portions with offset axes, said conductors separated and supported by a flexible elongated insulating member;

clamping a bracket to said conductors, said bracket having gripping portions that conform to the exposed portions of the conductors by contacting one of said gripping portions to one of said conductors and rotating said bracket with respect to said rail to cam said other gripping portion over the other conductor, wherein the gripping portions of the bracket clamp to the support rail to secure said bracket and constrain rotation of the bracket about the support rail; and electrically connecting a lamp fixture to said bracket, wherein electricity from said conductors may conduct directly through said bracket clamp legs to said fixture to provide power to an associated lamp.

26. The method of claim 25, comprising the additional steps of:

removing the clamp bracket from said support rail by simply rotating said bracket with respect to said rail so that one of said gripping portions rotates about its associated conductor and said other gripping portion cams over and swings away from its associated conductor to release said bracket from said rail.

27. The method of claim 25, further comprising providing a pair of spaced grooves for receiving said conductors, the conductors being cylindrical and at least partially exposed when seated in said grooves.

* * * * *